US006235093B1

(12) United States Patent
Okuhama et al.

(10) Patent No.: US 6,235,093 B1
(45) Date of Patent: May 22, 2001

(54) AQUEOUS SOLUTIONS FOR OBTAINING NOBLE METALS BY CHEMICAL REDUCTIVE DEPOSITION

(75) Inventors: Yoshiaki Okuhama; Takao Takeuchi; Keigo Obata; Yasuhito Kohashi, all of Akashi; Hidemi Nawafune, Takatsuki, all of (JP)

(73) Assignee: Daiwa Fine Chemicals Co., Ltd., Hyogen-Ken (JP)

( * ) Notice: Subject to any disclaimer, the term of this patent is extended or adjusted under 35 U.S.C. 154(b) by 0 days.

(21) Appl. No.: 09/340,892

(22) Filed: Jun. 28, 1999

(30) Foreign Application Priority Data

Jul. 13, 1998 (JP) ..... 10-197272

(51) Int. Cl.[7] ..... C23C 18/31; C23C 18/44; C23C 18/54

(52) U.S. Cl. ..... 106/1.18; 106/1.19; 106/1.22; 106/1.23; 106/1.24; 106/1.26; 106/1.28

(58) Field of Search ..... 106/1.18, 1.19, 106/1.22, 1.23, 1.24, 1.26, 1.28

(56) References Cited

U.S. PATENT DOCUMENTS

| | | | | |
|---|---|---|---|---|
| 3,960,564 | * | 6/1976 | Molenaar et al. | 106/1.23 |
| 4,830,668 | * | 5/1989 | Wundt et al. | 106/1.23 |
| 4,880,464 | * | 11/1989 | Ushio et al. | 106/1.26 |
| 5,202,151 | * | 4/1993 | Ushio et al. | 427/98 |
| 5,232,492 | * | 8/1993 | Krulik et al. | 106/1.23 |
| 5,258,062 | * | 11/1993 | Nakazawa et al. | 106/1.23 |
| 5,312,480 | * | 5/1994 | Lotze et al. | 106/1.23 |
| 5,318,621 | * | 6/1994 | Krilik et al. | 106/1.23 |
| 5,322,553 | * | 6/1994 | Mandich et al. | 106/1.23 |
| 5,338,343 | * | 8/1994 | Kroll et al. | 106/1.23 |
| 5,470,381 | * | 11/1995 | Kato et al. | 106/1.23 |
| 5,718,745 | * | 2/1998 | Itoh et al. | 106/1.22 |

FOREIGN PATENT DOCUMENTS

1/268876 * 10/1989 (JP) .
4/032575 * 2/1992 (JP) .
7/331452 * 12/1995 (JP) .

OTHER PUBLICATIONS

Derwent absrtact of JP01/268876, 10/1989.*
Derwent abstract of jp04/032575, 2/1992.*
Derwent avstract of JP07/331452, 12/ 1995.*
*Electroless Plating: Its Basic Applications*, Edited by Society of Electroplating, Japan, pp. 2–6, (May 30, 1994), (translation of p. 3).
Tokuzo Kanbe, *Electroless Plating*, pp. 80–81, 84–85, 88–89, 166–167, (Jun. 5, 1986), (translation of pp. 80 & 84).
*Text Book of Plating*, Edited by Society of Electroplating, Japan, pp. 230–231, 292–293, (Sep. 20, 1986), (translation of p. 230).

* cited by examiner

*Primary Examiner*—Helene Klemanski
(74) *Attorney, Agent, or Firm*—Akin, Gump, Strauss, Hauer & Feld, L.L.P.

(57) ABSTRACT

An aqueous solution for obtaining a noble metal by chemical reduction containing at least one water-soluble compound or complex of a metal selected from the group consisting of gold, platinum, silver, and palladium as a source of the metal to be deposited, and at least one mercapto compound or sulfide compound or a salt thereof as a reducing agent. The reducing agent is typically mercaptoacetic acid, 2-mercaptopropionic acid, 2-aminoethanethiol, 2-mercaptoethanol, glucose cysteine, 1-thioglycerol, sodium mercaptopropanesulfonate, N-acetylmethionine, thiosalicylic acid, 2-thiazoline-2-thiol, 2,5-dimercapto-1,3,4-thiadiazole, 2-benzothiazolethiol, or 2-benzimidazolethiol. They may be used singly or in combination.

4 Claims, 1 Drawing Sheet

AQUEOUS SOLUTIONS FOR OBTAINING NOBLE METALS BY CHEMICAL REDUCTIVE DEPOSITION

BACKGROUND OF THE INVENTION

1. Field of the Invention

This invention relates to a technique for obtaining metals by reductive deposition process, more particularly, to a process for obtaining noble metals by the chemical reduction by allowing an aqueous solution of a noble metal to contain a —SH or —S— containing compound as a reducing agent.

2. Description of the Prior Art

Chemical reduction and deposition of metals from their aqueous solutions with the aid of a reducing agent has been utilized in the method of obtaining metal coatings known as autocatalytic electroless plating and also in the process for producing (fine) metal particles for catalyst and other applications.

Reducing agents thus far reported for use in depositing metals from their solutions have included: e.g., for the deposition of gold, borohydride, dimethylamine borane, phosphinic acid, hydrazine, hydroxylamine, hydrazine boron, thiourea, ascorbic acid, titanium trichloride, formaldehyde, tartaric acid, glyoxylic acid, and formic acid; for platinum, hydrazine; for silver, glucose, formaldehyde, dextrin, glyoxal, ascorbic acid, sorbitol, hydroxylamine, hydrazine, borohydride, and dimethylamine borane; and for palladium, hydrazine, phosphinic acid, and trimethylamine borane (all inclusive of their salts).

Deposition can take place with reducing agents other than those mentioned above for the respective metals. However, gold, platinum, silver, palladium, etc. are noble metals, and the deposition potentials being noble, they are easily reduced and hence their deposition rates are rather difficult to control. There has generally been a contradictory fact that from the standpoint of productivity a high deposition rate is desirable but the conditions that permit fast deposition tend to make the solution and hence the complex unstable.

With these in view, the present invention is aimed at developing novel reducing agents f or the deposition of noble metals by chemical reduction and also developing aqueous solutions from which noble metals can be obtained by chemical reduction, the solutions remaining stable under the conditions that make high rates of deposition possible.

SUMMARY OF THE INVENTION

The present inventors took notice of the fact that compounds containing sulfur in the form of —SH or —S— have reducing action and exert complexing action on noble metals such as gold, platinum, silver, and palladium. They have studied intensively with the idea that, when such a compound was utilized as a reducing agent, increasing the concentration of the agent would raise the deposition rate, while at the same time increasing the complexing agent concentration and thereby achieving the stability of the solution. As a result it has now been found that the below-mentioned compounds can serve as novel reducing agents for the noble metals such as gold, platinum, silver, and palladium, and the industrial problems in the formation of noble metal coatings or in the production of fine particles of noble metals by chemical reduction method have just been settled.

Thus the invention provides an aqueous solution for obtaining a noble metal coating or fine particles by chemical reduction process characterized in that the solution contains one or two or more of water-soluble compounds or complexes of a metal selected from the group consisting of gold, platinum, silver, and palladium as a source or sources of the metal to be deposited and which solution also contains one or two or more of a mercapto compound or sulfide compound or their salts as a reducing agent or agents.

The aforementioned problems have now been solved by the discovery that the use of the compounds defined in (A) to (C) below as reducing agents permits the preparation of a solution which satisfies both of the contradictory conditions referred to above:

(a) a mercapto compound, a sulfide compound, and/or their salt or salts represented by the general formula (1)

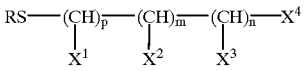

(1)

in which p, m, and n each are integers of 1 or 0, not all being 0 at the same time, $X^1$ and $X^2$ are hydrogen, OH, $NH_2$, or COOH independently of each other, $X^3$ is hydrogen, OH, $NH_2$, $SO_3H$, or COOH, $X^1$, $X^2$, or $X^3$ being not duplicated as COOH, COOH and $SO_3H$ being not overlapped, nor all being hydrogen concurrently, $X^4$ is hydrogen, methyl group, $NHCOCH_3$, or a carboxyl group esterified by condensation with the hydroxyl group of glucose with the proviso that when $X^4$ is $NHCOCH_3$, p, m and n are all 1, and R is hydrogen, a methyl or ethyl group;

(B) an aromatic mercapto compound represented by the general formula (2)

$$HS—\phi—(X)_n \quad (2)$$

in which n is an integer of 0–3, ϕ is a benzene ring, and X is hydrogen, $NH_2$, or COOH, which may be different when n is 2 or 3; and/or (C) a compound of imidazole, benzimidazole, thiazole, benzothiazole, imidazoline, thiazoline, triazole, benzotriazole, or thiadiazole in which the hydrogen on the carbon of the five-member ring is substituted by mercapto group.

Of these compounds, those which may be cited as examples particularly suited for industrial use are mercaptoacetic acid, 2-mercaptopropionic acid, 2-aminoethanethiol, 2-mercaptoethanol, glucose cysteine, 1-thioglycerol, sodium mercaptopropanesulfonate, N-acetylmethionine, thiosalicylic acid, 2-thiazoline-2-thiol, 2,5-dimercapto-1,3,4-thiadiazole, 2-benzothiazolethiol, and 2-benzimidazolethiol.

DETAILED DESCRIPTION OF THE INVENTION

Figure 1:
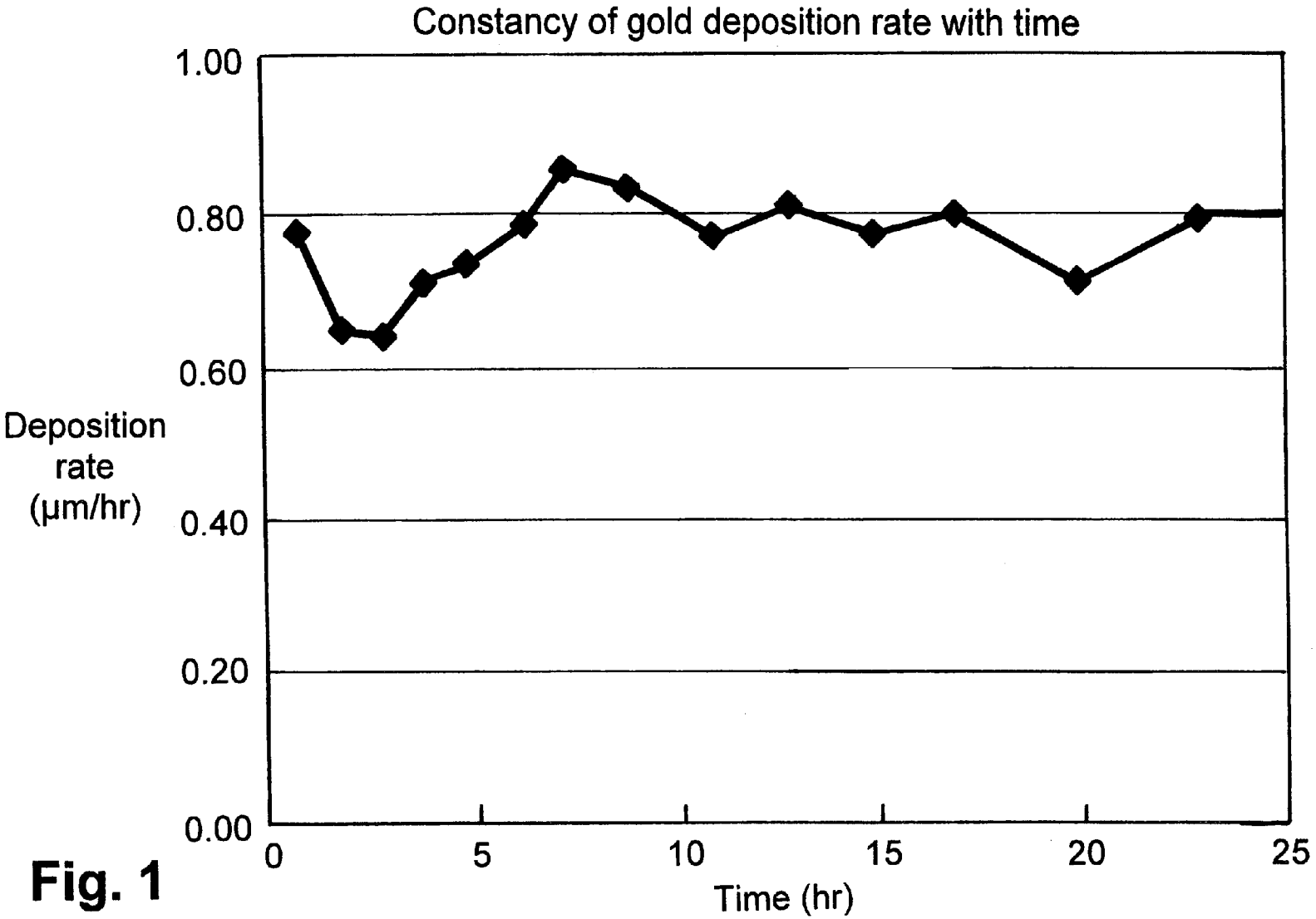
FIG. 1 is a graph showing constancy of deposition rate with time in an electroless plating of gold from an aqueous solution according to the invention.

The amount of the compound or compounds to be used may be suitably chosen depending on the desired rate of deposition and other considerations but is usually in the range of 1 to 100 g/l, preferably 5 to 50 g/l.

These compounds possess not only reducing action but also complexing action on metals. Thus they provide solutions extremely stable when stored at ordinary temperature, and proper heating allows the solutions to effect reductive deposition at a desired rate.

The temperature suited for deposition may be changed as desired in consideration of the purpose, intended use, concentration, etc., but is usually between 40° C. and the boiling point, preferably between 50 and 90° C.

In preparing an aqueous solution for the reductive deposition of a noble metal with the aid of the reducing agent, a water-soluble compound or complex of a metal selected from the group consisting of gold, platinum, silver, and palladium is used as a source of a metal to be deposited. Useful for this purpose is a compound or complex of gold, platinum, silver, or palladium which contains a compound or element, and/or one or two or more ionic species formed from such compound or element in the aqueous solution, selected from the group consisting of:

chlorine, bromine, iodine, acetic acid, nitric acid, nitrous acid, sulfuric acid, thiosulfuric acid, sulfurous acid, thiosulfurous acid, thiocyanic acid, cyanide, ammonia, ethylenediamine, citric acid, tartaric acid, gluconic acid;

mercaptocarboxylic acids of the general formula (3)

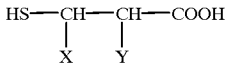

(3)

in which X is hydrogen or a carboxyl group and Y is hydrogen, an amino group, or —NH—CO—$CH_3$;

urea, thiourea, thioacetamide, and their derivatives of the general formula (4)

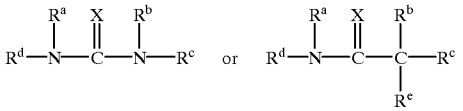

(4)

in which X is oxygen or sulfur, $R^a$ and $R^b$ are independently hydrogen, amino group or $C_{1-5}$ alkyl, $R^c$ and $R^d$ are independently hydrogen or $C_{1-5}$ alkyl, alkenyl or phenyl,the hydrogen in said alkyl, alkenyl, and/or phenyl may be substituted by hydroxyl or an amino, monomethylamino or dimethylamino group, and $R^c$ and $R^d$ may be bound to form a ring, and $R^e$ is an alkyl, allyl, or hydroxyl group;

aliphatic sulfonic acids of the general formula (5)

$$R—SO_3H \quad (5)$$

in which R is a $C_{1-12}$ alkyl or $C_{2-3}$ alkenyl group, and the hydrogen in the R may be substituted by from 0 to 3 hydroxyl, alkyl, aryl, alkylaryl, carboxyl, or sulfonic acid groups, at desired points in the R;

halogenated alkanesulfonic or alkanolsulfonic acids of the general formula (6)

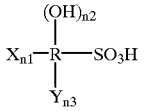

(6)

in which R is a $C_{1-3}$ alkyl, X is a halogen, being chlorine and/or fluorine, which may be at a desired point of the R, the number n1 of the halogens substituted for the hydrogen in the R ranges from 1 to the number of all the hydrogen atoms coordinated to the R, the substituted halogen species being one or two, the hydroxyl group may be at any desired point of the R, the number n2 of the hydroxyl group substituted for the hydrogen in the R is 0 or 1, and Y is a sulfonic acid group, which may be at any desired point of the R, the number n3 of the sulfonic acid groups represented by Y being in the range from 0 to 2; and aromatic sulfonic acids of the general formula (7)

$$X_n—\phi—SO_3H \quad (7)$$

in which is a benzene ring, X is a hydroxyl, alkyl, aryl, alkylaryl, aldehyde, carboxyl, nitro, mercapto, sulfonic acid, or amino group, or alternatively two Xs may combine with the benzene ring to form a naphthalene ring, the number n of substitution of the group being in the range from 0 to 3.

The compounds represented by the general formulas may be listed below as concrete examples. The mercaptocarboxylic acids of the general formula (3) are, e.g., mercaptosuccinic acid, cysteine, and acetylcysteine.

The urea, thiourea, thioacetamide, and their derivatives of the general formula (4) include thiourea, imidazolidinone, 2-imidazolidinethione, trimethylthiourea, N,N'-di-n-butylthiourea, tetramethylthiourea, 1-allyl-2-thiourea, N,N'-diethylthiourea, 1,3-bis(dimethylaminopropyl)-2-thiourea, N,N-dimethylthiourea, N,N-dimethylolurea, thiosemicarbazide, 4-phenyl-3-thiosemicarbazide, and 2-thiobarbituric acid.

The examples of among the aliphatic sulfonic acids of the general formula (5) are methanesulfonic, ethanesulfonic, propanesulfonic, 2-propanesulfonic, butanesulfonic, 2-butanesulfonic, pentanesulfonic, hexanesulfonic, decanesulfonic, dodecanesulfonic, 2-hydroxyethane-1-sulfonic (isethionic), 2-hydroxypropane-1-sulfonic, 1-hydroxypropane-2-sulfonic, 3-hydroxypropane-1-sulfonic, 2-hydroxybutane-1-sulfonic, 2-hydroxypentane-1-sulfonic, 2-hydroxyhexane-1-sulfonic, 2-hydroxydecane-1-sulfonic, 2-hydroxydodecane-1-sulfonic, 1-carboxyethanesulfonic, 2-carboxyethanesulfonic, 1,3-propanedisulfonic, 2-sulfoacetic, 2-sulfopropionic, 3-sulfopropionic, sulfosuccinic, sulfofumaric, and allylsulfonic acids.

Examples of the halogenated alkanesulfonic or alkanolsulfonic acids of the general formula (6) are monochloromethanesulfonic, perchloroethanesulfonic, trichlorodifluoropropanesulfonic, perfluoroethanesulfonic, monochlorodifluoromethanesulfonic, trifluoromethanesulfonic, trifluoroethanesulfonic, tetrachloropropanesulfonic, trichlorodifluoroethanesulfonic, monochloroethanolsulfonic, dichloropropanolsulfonic, and monochlorodifluorohydroxypropanesulfonic acids.

Examples of the aromatic sulfonic acids of the general formula (7) are benzenesulfonic, p-phenolsulfonic, toluenesulfonic, xylenesulfonic, nitrobenzenesulfonic, sulfobenzoic, sulfosalicylic, benzaldehydesulfonic, phenol-2,4-disulfonic, and sulfophthalic acids.

The amount of the compound or compounds to be used may be suitably chosen depending on the desired rate of deposition and other considerations but usually ranges, as the particular metallic component, from 0.01 to 100 g/l, preferably from 0.1 to 80 g/l. The aqueous solution according to the invention may contain a pH buffer, surfactant, and/or impurity metal masking complexing agent to further stabilize the solution, uniform the deposition and extend the life of the solution.

To maintain a steady deposition rate as desired, it is possible to add a pH buffer to the aqueous solution of the invention from which a noble metal is to be deposited by chemical reduction.

The compounds to be used suitably as pH buffer are those usually used as such, including neutral and/or acid salts of sodium, potassium, ammonium of phosphoric, acetic, carbonic, boric, citric, and other acids. They are suitably used alone or in combination. The amount to be used, although there are no definite limits, usually ranges from 5 to 200 g/l, preferably from 10 to 100 g/l.

Where the aqueous solution of the invention for obtaining a noble metal by reduction is to be employed as an electroless plating bath, a surfactant may be added to the solution so as to enable the object of plating to be rapidly wetted with the solution, to improve the appearance of the deposits, and, where fine noble metal particles are to be obtained, to avoid the aggregation of the fine particles.

The compounds that can be suitably used as surfactants are the cationic, anionic, nonionic, and amphoteric surfactants usually used in plating baths. They are used singly or as a mixture as desired.

As suitable surfactants, cationic surfactants include tetra-lower alkylammonium halides, alkyltrimethylammonium halides, hydroxyethyl alkyl imidazoline, polyoxyethylene alkyl methyl ammonium halides, alkylbenzalkonium halides, alkyldimethyl ammonium halides, alkyldimethyl benzyl ammonium halides, alkylamine hydrochlorides, alkylamine acetates, alkylamine oleates, alkylaminoethyl glycine, and alkylpyridinium halides. Among anionic surfactants are alkyl(or formalin condensate)-β-naphthalenesulfonic acids (or their salts), fatty acid soaps, alkyl sulfonates, α-olefin sulfonates, alkylbenzenesulfonates, alkyl(or alkoxy) naphthalenesulfonates, alkyldiphenyl ether disulfonates, alkyl ether sulfonates, alkylsulfuric esters, polyoxyethylene alkyl ether sulfuric esters, polyoxyethylene alkyl phenol ether sulfuric esters, higher alcohol phosphoric monoesters, polyoxyalkylene alkyl ether phosphoric acids (phosphates), polyoxyalkylene alkyl phenyl ether phosphates, polyoxyalkylene phenyl ether phosphates, polyoxyethylene alkyl ether acetates, alkanoyl sarcosines, alkanoyl sarcosinates, alkanoyl methylalanine salts, alkyl sulfoacetates, acyl methyl taurines, alkyl fatty acid glycerin sulfuric esters, hardened coconut oil fatty acid glyceryl sulfates, alkyl sulfocarboxylic esters, alkyl sulfosuccinates, dialkyl sulfosuccinates, alkyl polyoxyethylene sulfosuccinates, and sodium (or ammonium or TEA) sulfosuccinic monooleylamides.

Nonionic surfactants are, e.g., polyoxyalkylene alkyl ethers (or esters), polyoxyalkylene phenyl (or alkylphenyl) ethers, polyoxyalkylene naphthyl (or alkylnaphthyl) ethers, polyoxyalkylene styrenated phenyl ethers (or surfactants prepared by further adding a polyoxyalkylene to the phenyl group), polyoxyalkylene bisphenol ethers, polyoxyethylene-polyoxypropylene block polymers, polyoxyalkylene sorbitan fatty acid esters, polyoxyalkylene sorbitol fatty acid esters, polyethylene glycol fatty acid esters, polyoxyalkylene glycerin fatty acid esters, polyoxyalkylene alkylamines, polyoxyalkylene condensate adducts of ethylenediamine, polyoxyalkylene alkylene fatty acid amides, polyoxyalkylene castor (or/and hardened castor) oils, polyoxyalkylene alkyl phenyl formalin condensates, glycerin (or polyglycerin) fatty acid esters, pentaerythritol fatty acid esters, sorbitan mono(sesqui, tri) fatty acid esters, higher fatty acid mono(di)ethanolamides, alkyl-alkylolamides, and oxyethylene alkylamines.

Amphoteric surfactants include 2-alkyl-N-carboxymethyl (or ethyl)-N-hydroxyethyl(or methyl) imidazolinium betaines, 2-alkyl-N-carboxymethyl(or ethyl)-N-carboxymethyloxyethyl imidazolinium betaines, dimethylalkyl betaines, N-alkyl-β-aminopropionic acids (or their sodium salts), alkyl(poly)aminoethylglycine, N-alkyl-N-methyl-p-alanines (or their sodium salts), and fatty acid amidopropyl dimethylaminoacetic acid betaines.

The amount of such a surfactant or surfactants to be used may be suitably chosen but generally ranges from about 0.001 to about 50 g/l, preferably from 0.01 to 50 g/l.

Tiny fragments of equipment and its rust can float in the operational environments, and fine metal particles that fall into the solution and also impurity metal ions, e.g., the ions of copper, nickel, and iron, that have dissolved out of the object being plated can codeposit with the desired metal or deteriorate the solution. To preclude or inhibit such possibilities, the aqueous solution of the invention to obtain a noble metal coating and/or particles by reduction may further contain a complexing agent for the purpose of impurity metal masking.

For this purpose the compounds usually employed as complexing agents may be properly chosen and used singly or in combination, suitable ones being oxycarboxylic acids or polycarboxylic acids such as glycolic, malonic, lactic, malic, tartaric, citric, and gluconic acids (and their salts).

Also useful are aminecarboxylic acids such as ethylenediaminetetraacetic acid, 1,2-diaminocyclohexane-N,N,N',N'-tetraacetic acid, 1,3-diaminohydroxypropane-N,N,N',N'-tetraacetic acid, diethylenetriamine-N,N,N',N",N"-pentaacetic acid, N,N-bis(2-hydroxyethyl)glycine, iminodiacetic acid, nitrilotriacetic acid, and nitrilotripropionic acid (and their salts).

The sufficient amount of the masking complexing agent to be used to achieve the above-mentioned effect is between 1 and 100 g/l, preferably between 1 and 20 g/l.

Moreover, a stabilizer conventionally used to improve the stability of an autocatalytic electroless plating bath may be added. Examples are compounds such as 2-mercaptobenzothiazole, 6-ethoxy-2-mercaptobenzothiazole, and their cyclohexylamine salts or sodium-S-propanesulfonates, dithizones, and 1,10-phenanethroline chlorides.

The aqueous solution thus far described for obtaining a noble metal by chemical reduction in accordance with the invention is suitably used in the reductive deposition of gold, platinum, silver, and palladium or their alloys from aqueous solutions by using a reducing agent, i.e., in the production of fine metal particles, deposition of metals, electroless plating or chemical reductive deposition.

The invention is illustrated by the following several examples, which are not in any way limitative; the conditions to be used may be changed appropriately to suit the intended use and purpose without departing from the scope of the claims.

EXAMPLE 1

| Solution 1 | |
|---|---|
| Gold mercaptosuccinate | 2 g/l (as gold) |
| Mercaptosuccinic acid | 10 g/l (as gold) |
| 2-Aminoethanethiol hydrochloride | 20 g/l (as gold) |
| Potassium dihydrogenphosphate | 20 g/l (as gold) |
| pH | 7 |
| Plating temperature | 80° C. |

Solution 1 of the above composition was prepared to obtain a coating of gold by electroless plating. The resulting solution was kept at 80° C. and a pure gold sheet was immersed into the bath for 2 hours. The thickness of the coating formed was calculated from the difference in weight between the values measured before and after the immersion. A gold coating about 2.5 μm thick was obtained. When stored at ordinary temperature, Solution 1 remained very stable for more than 3 months.

Comparative Example 1

| Solution 2 | |
|---|---|
| Gold mercaptosuccinate | 2 g/l (as gold) |
| Mercaptosuccinic acid | 10 g/l (as gold) |
| Potassium dihydrogenphosphate | 20 g/l (as gold) |
| pH | 7 |
| Plating temperature | 80° C. |

Solution 2 was prepared in the manner described in Example 1 with the exception that 2-aminoethanethiol hydrochloride was omitted from the composition of Solution 1, and in the same way a pure gold sheet was immersed in the bath. No gold was deposited from Solution 2, and this proved that 2-aminoethanethiol acts as a reducing agent.

EXAMPLE 2

| Solution 3 | |
|---|---|
| Gold mercaptosuccinate | 2 g/l (as gold) |
| Mercaptosuccinic acid | 10 g/l (as gold) |
| 2-Aminoethanethiol hydrochloride | 20 g/l (as gold) |
| Potassium dihydrogenphosphate | 10 g/l (as gold) |
| pH | 7 |
| Plating temperature | 80° C. |

Solution 3 of the above composition was prepared and was subjected to a time variability test while plating was carried on with the replenishment of gold compound at intervals of 1 to 3 hours. As FIG. 1 indicates, gold coatings having good appearance were deposited for more than 20 hours. The last point of time plotted in FIG. 1 is equivalent to about 2.6 turns, showing that the solution was highly stable.

EXAMPLE 3

| Solution 4 | |
|---|---|
| Gold mercaptosuccinate | 2 g/l (as gold) |
| Acetylcysteine | 10 g/l (as gold) |
| Cystine | 10 g/l (as gold) |
| 2-Mercaptoethanol | 20 g/l (as gold) |
| Potassium dihydrogenphosphate | 20 g/l (as gold) |
| pH | 10 |
| Plating temperature | 80° C. |

Solution 4 of the above composition was prepared and a pure gold sheet was immersed in it for one hour. A favorable gold coating about 0.7 μm thick was deposited. Solution 4 was very stable for more than 3 months when stored at ordinary temperature.

EXAMPLE 4

| Solution 5 | |
|---|---|
| Gold acetylcysteine | 2 g/l (as gold) |
| Cysteine | 10 g/l (as gold) |
| Mercaptoacetic acid | 20 g/l (as gold) |
| Potassium dihydrogenphosphate | 20 g/l (as gold) |
| pH | 7 |
| Plating temperature | 70° C. |

Solution 5 of the above composition was prepared and a pure gold sheet was immersed in it for one hour. A favorable gold coating about 0.5 μm thick was deposited. Solution 5 was very stable for more than 3 months when stored at ordinary temperature.

EXAMPLE 5

| Solution 6 | |
|---|---|
| Gold mercaptosuccinate | 2 g/l (as gold) |
| Mercaptosuccinic acid | 10 g/l (as gold) |
| Reducing agent | 10 g/l (as gold) |
| Potassium dihydrogenphosphate | 20 g/l (as gold) |
| pH | 7 |
| Plating temperature | 80° C. |

Solution 6 of the above composition was prepared in variations with different kinds of reducing agent, and a pure gold sheet was immersed in each for 2 hours. The rates of deposition of gold coatings are listed in Table 1. All variations of the solution were highly stable.

TABLE 1

| Kind of reducing agent | Deposition rate (μm/2 hrs) |
|---|---|
| 3-Mercaptopropionic acid | 0.18 |
| Thiosalicyclic acid | 0.23 |
| 1-Thioglycerol | 0.19 |
| Glucose cysteine | 0.25 |
| 2,2'-Thiodiacetic acid | 0.19 |
| N-Acetylmethionine | 0.17 |
| 2-Mercaptobenzothiazole | 0.05 |

EXAMPLE 6

| Solution 7 | |
|---|---|
| Gold mercaptosuccinate | 2 g/l (as gold) |
| Mercaptosuccinic acid | 10 g/l (as gold) |
| Mercaptoacetic acid | 10 g/l (as gold) |
| Hydroxyethyl alkyl imidazoline | 1 g/l (as gold) |
| Potassium dihydrogenphosphate | 20 g/l (as gold) |
| pH | 6 |
| Plating temperature | 90° C. |

Solution 7 of the above composition was prepared and kept at 90° C. for about 7 hours. Very fine gold particles were obtained. Solution 7 proved extremely stable for over 3 months in storage at ordinary temperature.

EXAMPLE 7

| Solution 8 | |
|---|---|
| Dinitrodiammineplatinum | 2 g/l (as platinum) |
| Ammonia water | 20 ml/l |
| Acetylcysteine | 40 g/l |
| Hydroxylamine hydrochloride | 1 g/l |
| pH | 9 |
| Plating temperature | 70° C. |

Solution 8 of the above composition was prepared, and a palladium-plated test specimen was immersed in the solution for about 5 hours. Platinum deposition on the specimen was confirmed by EDAX. Solution 8 remained extremely stable for more than 3 months in storage at ordinary temperature.

EXAMPLE 8

| Solution 9 | |
|---|---|
| Silver methanesulfonate | 10 g/l (as silver) |
| N-Acetylcysteine | 20 g/l (as silver) |
| 2-Aminoethanethiol | 20 g/l (as silver) |
| pH | 5.5 |
| Temperature | 50° C. |

Solution 9 of the above composition was prepared and kept at 50° C. for 100 hours. Very fine silver particles were obtained. Solution 9 remained extremely stable for more than 3 months when stored at ordinary temperature.

EXAMPLE 9

| Solution 10 | |
|---|---|
| Palladium chloride | 1 g/l (as Palladium) |
| Ethylenediamine monohydrate | 7 g/l (as Palladium) |
| L-Cysteine | 20 g/l (as Palladium) |
| Thioglycolic acid | 0.05 g/l (as Palladium) |
| 2-Aminoethanethiol hydrochloride | 10 g/l (as Palladium) |
| pH | 6.5 |
| Temperature | 80° C. |

Solution 10 of the above composition was prepared and a test specimen of pure gold sheet was immersed in the solution for about 2 hours. A palladium deposit on the specimen was confirmed by EDAX. Solution 10 remained very stable for more than 3 months when stored at ordinary temperature.

As has been described above, the use of a specific mercapto compound or sulfide compound as a novel reducing agent brings a concurrent effect of using a complexing agent too because the compound has both reducing and complexing actions. Thus it makes the provision of an aqueous solution which is easy to prepare, highly stable in storage at ordinary temperature, and permits the deposition of noble metals by reduction, with the rate of deposition easily controllable as desired by appropriate heating.

What is claimed is:

1. An aqueous solution for obtaining a noble metal by chemical reduction therefrom comprising, besides water, at least one water-soluble compound or complex of a metal selected from the group consisting of gold, platinum, silver, and palladium as a source of the metal to be deposited, and at least one mercapto compound or sulfide compound or a salt thereof as a reducing agent, wherein the mercapto or sulfide compound is present in an amount of 1 to 100 g/l.

2. The aqueous solution according to claim 1 wherein the at least one mercapto compound or sulfide compound contained as a reducing agent is:

(A) a mercapto compound, a sulfide compound and/or a salt thereof represented by the general formula (1)

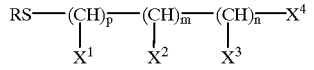

(1)

in which p, m, and n each are integers of 1 or 0, not all being 0 at the same time; $X^1$ and $X^2$ are hydrogen, OH, $NH_2$, or COOH independently of each other; $X^3$ is hydrogen, OH, $NH_2$, $SO_3H$, or COOH, wherein not more than one of $X^1$, $X^2$ and $X^3$ can be COOH concurrently, and wherein if $X^3$ is $SO_3H$, neither $X^1$ nor $X^2$ can be COOH, nor can all of $X^1$, $X^2$, $X^3$ be hydrogen concurrently; $X^4$ is hydrogen, a methyl group, $NHCOCH_3$, or a carboxyl group esterified by condensation with the hydroxyl group of glucose with the proviso that when $X^4$ is $NHCOCH_3$, p, m and n are all 1; and R is hydrogen, a methyl or ethyl group;

(B) an aromatic mercapto compound represented by the general formula (2)

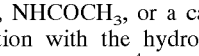

(2)

in which n is an integer of 0–3, ϕ is a benzene ring, and X is hydrogen, $NH_2$, or COOH, which may be different when n is 2 or 3; and/or (C) a compound of imidazole, benzimidazole, thiazole, benzothiazole, imidazoline, thiazoline, triazole, benzotriazole, or thiadiazole in which the hydrogen on the carbon of the five-membered ring is substituted by a mercapto group.

3. An aqueous solution for obtaining a noble metal by chemical reduction therefrom comprising, besides water, at least one water-soluble compound or complex of a metal selected from the group consisting of gold, platinum, silver, and palladium as a source of the metal to be deposited, and at least one mercapto compound or sulfide compound or a salt thereof as a reducing agent, wherein the at least one mercapto or sulfide compound contained as a reducing agent is selected from the group consisting of mercaptoacetic acid, 2-mercaptopropionic acid, 2-aminoethanethiol, 2-mercaptoethanol, glucose cysteine, 1-thioglycerol, sodium mercaptopropanesulfonate, N-acetylmethionine, thiosalicylic acid, 2-thiazoline-2-thiol, 2,5-dimercapto-1,3,4-thiadiazole, 2-benzothiazolethiol and 2-benzimidazolethiol.

4. The aqueous solution according to claim 1, which is a solution for electroless plating.

* * * * *